US009398790B1

(12) United States Patent
Ketcher

(10) Patent No.: US 9,398,790 B1
(45) Date of Patent: Jul. 26, 2016

(54) PERSONAL RECORDING NECKLACE AND PENDANT SYSTEM

(71) Applicant: Wayne A. Ketcher, Seminole, OK (US)

(72) Inventor: Wayne A. Ketcher, Seminole, OK (US)

( * ) Notice: Subject to any disclaimer, the term of this patent is extended or adjusted under 35 U.S.C. 154(b) by 252 days.

(21) Appl. No.: 14/081,807

(22) Filed: Nov. 15, 2013

(51) Int. Cl.
*H04R 1/02* (2006.01)
*A44C 15/00* (2006.01)
*A44C 25/00* (2006.01)

(52) U.S. Cl.
CPC ..... *A44C 15/005* (2013.01); *A44C 25/001* (2013.01)

(58) Field of Classification Search
None
See application file for complete search history.

(56) References Cited

U.S. PATENT DOCUMENTS 4,262,324 A * 4/1981 Murphy ..... F21L 11/00 362/104
4,764,111 A 8/1988 Knierim
6,111,495 A 8/2000 Garside
7,120,266 B2 10/2006 Iwasa et al.
7,650,007 B2 1/2010 Iuliis et al.
D641,349 S 7/2011 Baumann et al.
8,060,031 B2 11/2011 Henderson
2004/0127189 A1* 7/2004 Olivier ..... H04M 1/05 455/350
2008/0101160 A1 5/2008 Besson
2009/0163241 A1* 6/2009 Vossoughi ..... H04M 1/0254 455/556.1
2009/0193847 A1 8/2009 Scott
2009/0273439 A1 11/2009 Selsor
2010/0077797 A1* 4/2010 Gordon ..... H04N 21/41407 63/1.11
2011/0200220 A1* 8/2011 Wright ..... H04R 1/028 381/332
2011/0216931 A1* 9/2011 Bui ..... H04R 1/1091 381/333

* cited by examiner

*Primary Examiner* — Davetta W Goins
*Assistant Examiner* — James Mooney

(57) ABSTRACT

A discreet personal recording necklace and pendant system for recording an audio signal for playback is suspended around a neck of a user. The system features a hollow tube adapted for housing wiring, a cylindrical clasp located on the hollow tube adapted for housing a power supply, and a pendant located on the hollow tube. The pendant features a microprocessor located in a pendant cavity connected to the power supply via wiring through the hollow tube. A pendant first surface has a capacitive touch sensor and a microphone. A pendant second surface features a speaker. The microprocessor is operated via a voice activation component in the microprocessor. The audio signal is received via the microphone and emitted via the speaker. The discreet personal recording necklace and pendant system for recording the audio signal for playback is suspended around the neck of the user.

10 Claims, 4 Drawing Sheets

PERSONAL RECORDING NECKLACE AND PENDANT SYSTEM

BACKGROUND OF THE INVENTION

The ability to recall important information is critical to the daily life of every person. Often a simple note may be used to record pertinent information. In cases where a writing utensil and writing surface are not present, other means may be used such as tying a string around a finger as a mental reminder or recording a message on a device such as a personal digital assistant or a mobile phone to be played back as a reminder. The present invention features a discreet personal recording necklace and pendant system for recording an audio signal for playback suspended around a neck of a user.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a discreet personal recording necklace and pendant system for recording an audio signal for playback suspended around a neck of a user. In some embodiments, the system comprises a hollow tube adapted for housing wiring. In some embodiments, the system comprises a cylindrical clasp located on the hollow tube adapted for housing a power supply. In some embodiments, the system comprises a pendant located on the hollow tube.

In some embodiments the pendant comprises a microprocessor located in a pendant cavity connected to the power supply via wiring through the hollow tube. In some embodiments, a pendant first surface comprises a capacitive touch sensor and a microphone located thereon. In some embodiments, a pendant second surface comprises a speaker located thereon.

In some embodiments, the microprocessor is operated via a voice activation component located in the microprocessor. In some embodiments, the audio signal is received via the microphone and emitted via the speaker. In some embodiments, the discreet personal recording necklace and pendant system for recording the audio signal for playback is suspended around the neck of the user.

DESCRIPTION OF PREFERRED EMBODIMENTS

Figure 1:
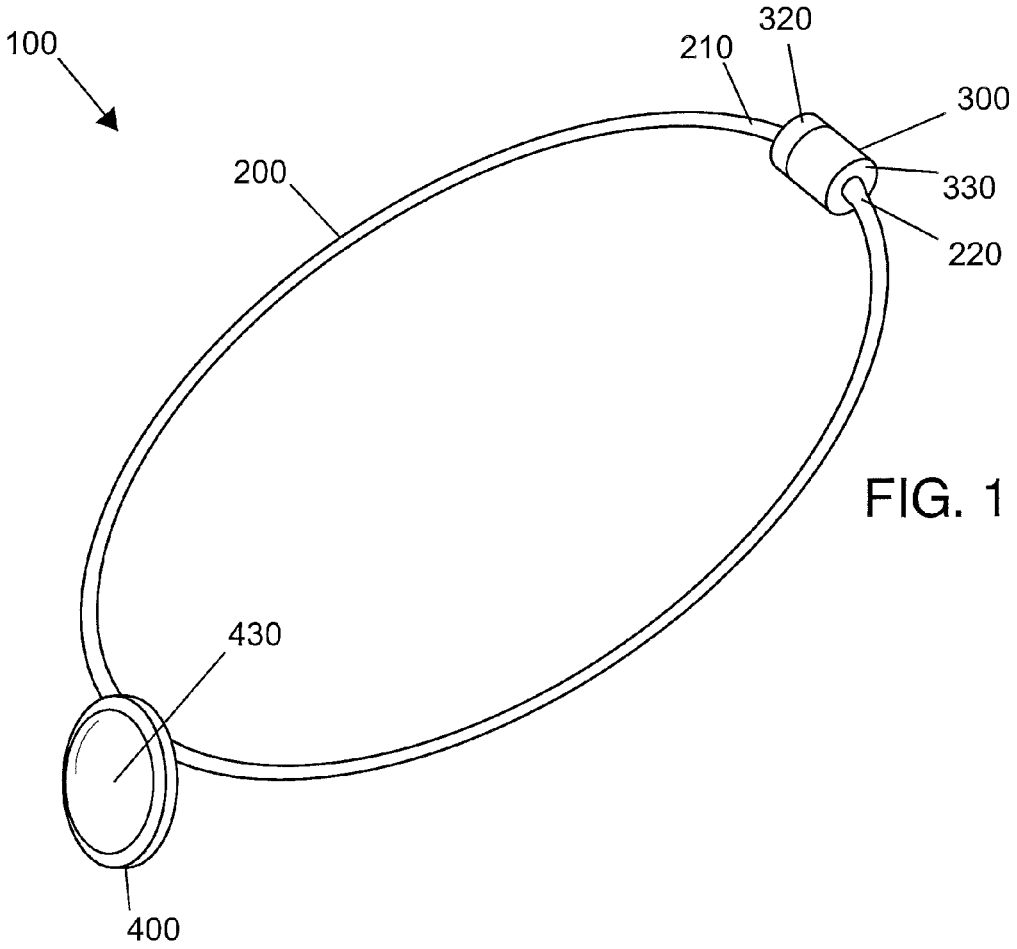
FIG. 1 shows a perspective view of the present invention.
Figure 2:
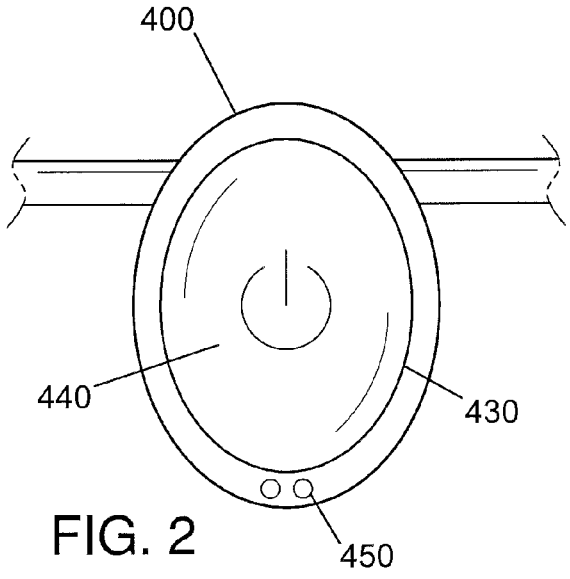
FIG. 2 shows a front view of the pendant of the present invention.
Figure 3A:
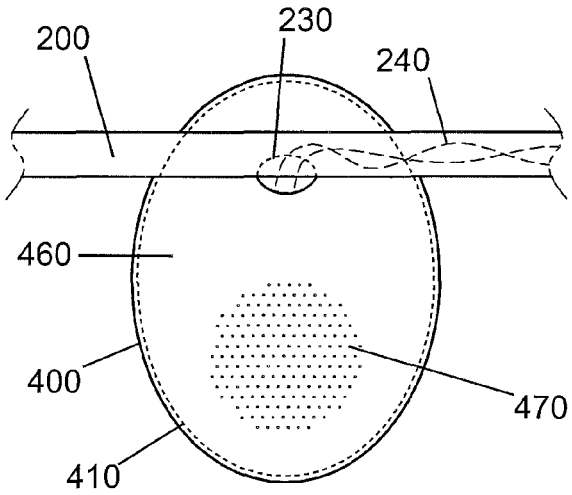
FIG. 3A shows a rear view of the pendant of the present invention.
Figure 3B:
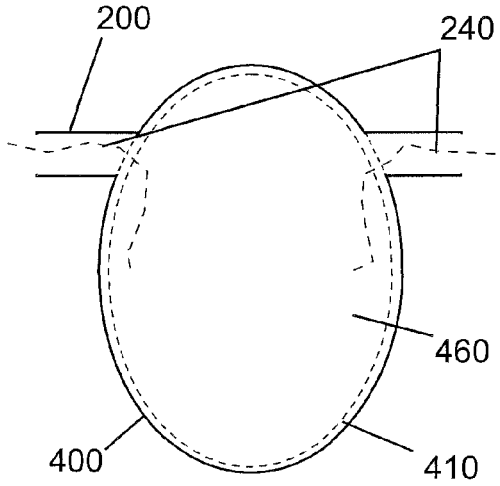
FIG. 3B shows a rear view of an alternate embodiment of the pendant of the present invention.
Figure 4B:
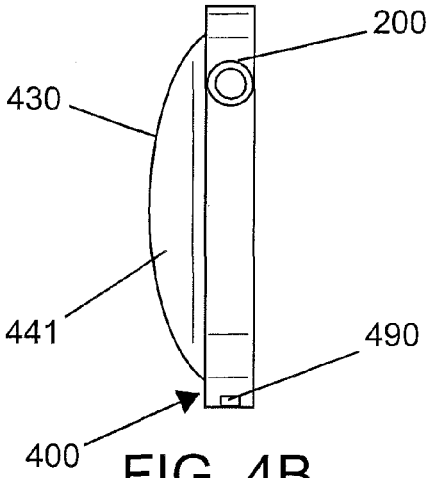
FIG. 4B shows a side view of an alternate embodiment of the pendant of the present invention.
Figure 4A:
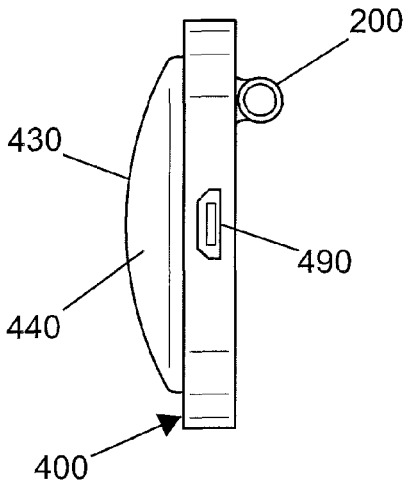
FIG. 4A shows a side view of the pendant of the present invention.
Figure 5:
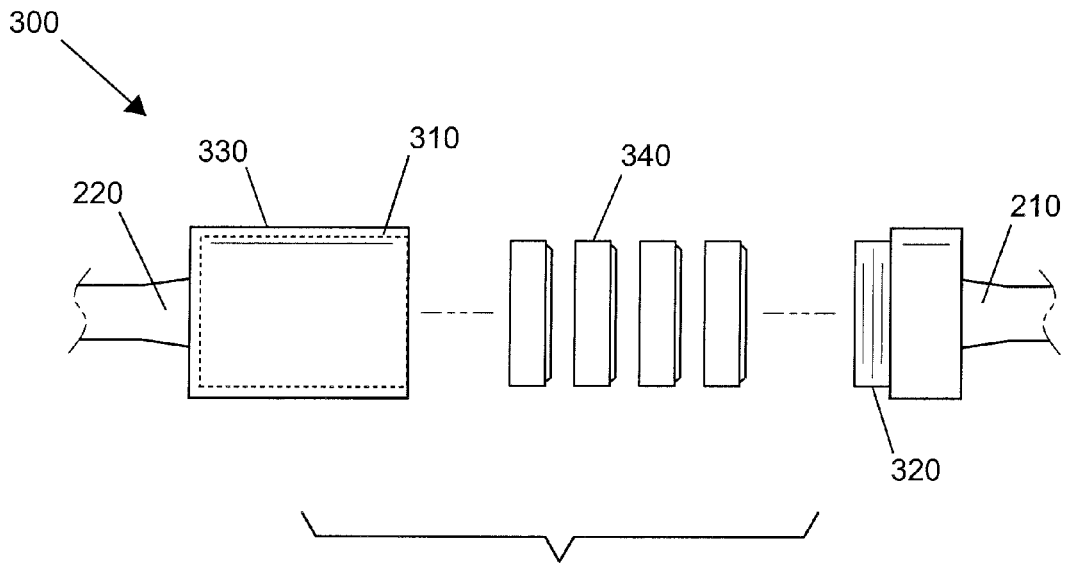
FIG. 5 shows an exploded view of the cylindrical clasp of the present invention.
Figure 6:
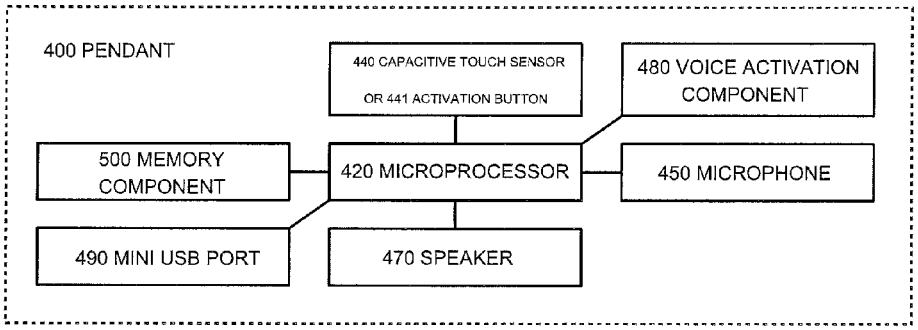
FIG. 6 shows a schematic view of the present invention.
Figure 7:
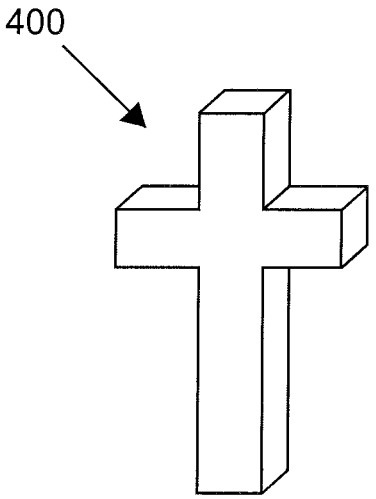
FIG. 7 shows an alternate embodiment of the pendant of the present invention.

Following is a list of elements corresponding to a particular element referred to herein:

100 Personal recording necklace and pendant system
200 Hollow tube
210 Tube first end
220 Tube second end
230 Tube wall aperture
240 Wiring
300 Cylindrical clasp
310 Clasp cavity
320 Clasp first side
330 Clasp second side
340 Power supply
400 Pendant
410 Pendant cavity
420 Microprocessor
430 Pendant first surface
440 Capacitive touch sensor
441 Activation button
450 Microphone
460 Pendant second surface
470 Speaker
480 Voice activation component
490 Mini USB (universal serial bus) port
500 Memory component Referring now to FIG. 1-7, the present invention features a discreet personal recording necklace and pendant system (100) for recording an audio signal for playback suspended around a neck of a user. In some embodiments, the system (100) comprises a hollow tube (200) having a tube first end (210), a tube second end (220), and a tube wall aperture (230) located thereon midway between the tube first end (210) and the tube second end (220). In some embodiments, the hollow tube (200) is adapted for housing wiring (240). In some embodiments, the hollow tube (200) is decorative. In some embodiments, the hollow tube (200) is segmented. In some embodiments, the hollow tube (200) is constructed from a plastic. In some embodiments, the hollow tube (200) is constructed from a metal. In some embodiments, the hollow tube (200) is flexible.

In some embodiments, the system (100) comprises a cylindrical clasp (300) comprising a clasp cavity (310) located therein. In some embodiments, the cylindrical clasp (300) comprises a clasp first side (320) that threadably connects to a clasp second side (330). In some embodiments, the clasp first side (320) is located on and fluidly connected to the hollow tube first end (210) and the clasp second side (330) is located on and fluidly connected to the hollow tube second end (220). In some embodiments, the cylindrical clasp (300) is adapted for housing a power supply (340).

In some embodiments, the system (100) comprises a pendant (400) non-rotatingly located on the hollow tube (200) opposite the cylindrical clasp (300) having a pendant cavity (410) located therein. In some embodiments, the pendant cavity (410) is fluidly connected to the tube wall aperture (230). In some embodiments, the pendant cavity (410) is fluidly connected to the hollow tube (200) via a first aperture and a second aperture, each disposed in a side wall of the pendant (400).

In some embodiments, the pendant (400) comprises a microprocessor (420) located in the pendant cavity (410)

operatively connected to the power supply (340) via wiring (240). In some embodiments, the pendant cavity (410) is fluidly connected to the hollow tube (200). In some embodiments, the pendant (400) comprises a pendant first surface (430) having a capacitive touch sensor (440) located thereon operatively connected to the microprocessor (420) and a microphone (450) located thereon operatively connected to the microprocessor (420). In some embodiments, the pendant (400) comprises a pendant first surface (430) having an activation button (441) located thereon operatively connected to the microprocessor (420) and a microphone (450) located thereon operatively connected to the microprocessor (420). In some embodiments, either the capacitive touch sensor (440) or the activation button (441) is used to send a command to operate the microprocessor (420).

In some embodiments, the pendant (400) comprises a pendant second surface (460) affixably located on the hollow tube (200). In some embodiments, the pendant second surface (460) comprises a speaker (470) located thereon operatively connected to the microprocessor (420).

In some embodiments, the microprocessor (420) is operated via a voice activation component (480) located in the microprocessor (420). In some embodiments, the voice activation component (480) is a computer program adapted to receive an audio signal and convert that data into commands. In some embodiments, the audio signal is received via the microphone (450). In some embodiments, the audio signal is emitted via the speaker (470).

In some embodiments, the capacitive touch sensor (440) comprises at least 75% of the surface area of the pendant first surface (430). In some embodiments, the capacitive touch sensor (440) comprises at least 90% of the surface area of the pendant first surface (430). In some embodiments, the capacitive touch sensor (440) resembles a precious or a semi-precious stone. In some embodiments, the capacitive touch sensor (440) displays a digital still image via the microprocessor (420). In some embodiments, the capacitive touch sensor (440) displays a digital video image via the microprocessor (420). Capacitive touch sensors (440) are well known to those of ordinary skill in the art.

In some embodiments, the pendant (400) comprises a mini USB port (490) located therein operatively connected to the microprocessor (420) for uploading to and downloading data from the microprocessor (420). In some embodiments, the pendant (400) comprises a memory component (500) located therein operatively connected to the microprocessor (420) for storing data.

In some embodiments, the system (100) comprises voice activation component (480) located in the microprocessor (420). In some embodiments, the voice activation component (480) is a computer program adapted to receive an audio signal and convert that data into commands. In some embodiments, the voice activation component (480) recognizes words such as "on", "off", "record", and "stop."

In some embodiments, the power supply (340) is a battery. In some embodiments, the power supply (340) is a plurality of batteries.

In some embodiments it is critical that the pendant (400) is a non-rotating pendant so that the pendant first surface (430) with the capacitive touch sensor (440) cannot contact the wearer. In some embodiments, it is critical that the power supply (340) is remotely located opposite the pendant (400) so that the weight is distributed more evenly. In some embodiments, it is critical that the capacitive touch sensor (440) occupies greater than 75% of the pendant first surface (430) for ease of use and decorative purposes.

Alternate Embodiment

In some embodiments, a discreet personal recording necklace and pendant system (100) for recording an audio signal for playback suspended around a neck of a user comprises a hollow tube (200) having a tube first end (210), and a tube second end (220). In some embodiments, the hollow tube (200) is adapted for housing wiring (240).

In some embodiments, the system (100) comprises a cylindrical clasp (300) comprising a clasp cavity (310) located therein. In some embodiments, the cylindrical clasp (300) comprises a clasp first side (320) that threadably connects to a clasp second side (330). In some embodiments, the clasp first side (320) is located on and fluidly connected to the hollow tube first end (210) and the clasp second side (330) is located on and fluidly connected to the hollow tube second end (220). In some embodiments, the cylindrical clasp (300) is adapted for housing a power supply (340).

In some embodiments, the system (100) comprises a pendant (400) non-rotatingly located in the hollow tube (200) opposite the cylindrical clasp (300) having a pendant cavity (410) located therein. In some embodiments, the pendant cavity (410) is fluidly connected to the hollow tube (200). In some embodiments, the pendant (400) comprises a microprocessor (420) located in the pendant cavity (410) operatively connected to the power supply (340) via wiring (240). In some embodiments, the pendant (400) comprises a pendant first surface (430) having an activation button (441) located thereon operatively connected to the microprocessor (420) and a microphone (450) located thereon operatively connected to the microprocessor (420). In some embodiments, the pendant (400) comprises a pendant second surface (460). In some embodiments, the pendant second surface (460) comprises a speaker (470) located thereon operatively connected to the microprocessor (420).

In some embodiments, the microprocessor (420) is operated via a voice activation component (480) located in the microprocessor (420). In some embodiments, the audio signal is received via the microphone (450). In some embodiments, the audio signal is emitted via the speaker (470). In some embodiments, the discreet personal recording necklace and pendant system (100) for recording the audio signal for playback is suspended around the neck of the user.

As used herein, the term "about" refers to plus or minus 10% of the referenced number.

The disclosures of the following U.S. Patents are incorporated in their entirety by reference herein: U.S. Pat. No. D 641,349; U.S. Patent Pub. No. 2009/0273439A1; U.S. Patent Pub. No. 2009/0193847 A1; U.S. Patent Pub. No. 2008/0101160 A1; U.S. Pat. No. 8,060,031; U.S. Pat. No. 7,120,266; U.S. Pat. No. 6,111,495; and U.S. Pat. No. 4,764,111.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way.

The reference numbers recited in the below claims are solely for ease of examination of this patent application, and are exemplary, and are not intended in any way to limit the scope of the claims to the particular features having the corresponding reference numbers in the drawings.

What is claimed is:

1. A discreet personal recording necklace and pendan system (100) for recording an audio signal for playback suspended around a neck of a user, wherein said system (100) comprises:

(a) a hollow tube (200) having a tube first end (210), a tube second end (220), and a tube wall aperture (230) disposed thereon midway between the tube first end (210) and the tube second end (220), wherein the hollow tube (200) is adapted for housing wiring (240);

(b) a cylindrical clasp (300) comprising a clasp cavity (310) disposed therein, wherein the cylindrical clasp (300) comprises a clasp first side (320) that threadably connects to a clasp second side (330), wherein the clasp first side (320) is disposed on and fluidly connected to the hollow tube first end (210) and the clasp second side (330) is disposed on and fluidly connected to the hollow tube second end (220), wherein the cylindrical clasp (300) is adapted for housing a power supply (340); and (c) a pendant (400) non-rotatingly disposed on the hollow tube (200) opposite the cylindrical clasp (300) having a pendant cavity (410) disposed therein, wherein the pendant cavity (410) is fluidly connected to the tube wall aperture (230), wherein the pendant (400) comprises:

(i) a microprocessor (420) disposed in the pendant cavity (410) operatively connected to the power supply (340) via wiring (240), wherein the pendant cavity (410) is fluidly connected to the hollow tube (200), (ii) a pendant first surface (430) having a capacitive touch sensor (440) disposed thereon operatively connected to the microprocessor (420) and a microphone (450) disposed thereon operatively connected to the microprocessor (420), and (iii) a pendant second surface (460) affixably disposed on the hollow tube (200), wherein the hollow tube (200) sits on the pendant second surface (460) protruding from the pendant second surface (460), wherein the pendant (400) is a non-rotating pendant, wherein the pendant second surface (460) comprises a speaker (470) disposed thereon operatively connected to the microprocessor (420), wherein the microprocessor (420) is operated via a voice activation component (480) disposed in the microprocessor (420), wherein the audio signal is received via the microphone (450), wherein the audio signal is emitted via the speaker (470), wherein the discreet personal recording necklace and pendant system (100) for recording the audio signal for playback is suspended around the neck of the user.

2. The system (100) of claim 1, wherein the capacitive touch sensor (440) comprises at least 75% of the surface area of the pendant first surface (430).

3. The system (100) of claim 1, wherein the capacitive touch sensor (440) comprises at least 90% of the surface area of the pendant first surface (430).

4. The system (100) of claim 1, wherein the capacitive touch sensor (440) resembles a precious or a semi-precious stone.

5. The system (100) of claim 1, wherein the capacitive touch sensor (440) displays a digital still image via the microprocessor (420).

6. The system (100) of claim 1, wherein the capacitive touch sensor (440) displays a digital video image via the microprocessor (420).

7. The system (100) of claim 1, wherein the pendant (400) comprises a mini USB port (490) disposed therein operatively connected to the microprocessor (420).

8. The system (100) of claim 1, wherein the pendant (400) comprises a memory component (500) disposed therein operatively connected to the microprocessor (420).

9. The system (100) of claim 1, wherein the power supply (340) is a battery.

10. The system (100) of claim 1, wherein the power supply (340) is a plurality of batteries.

* * * * *